US005860842A

United States Patent [19]

Parr

[11] Patent Number: 5,860,842

[45] Date of Patent: Jan. 19, 1999

[54] SELF-STEERING SYSTEM FOR WATERCRAFT

[75] Inventor: Barbara Catrin Parr, Wentorf, Germany

[73] Assignee: Gerd Schonrock, Wentorf, Germany

[21] Appl. No.: 737,872

[22] PCT Filed: Jun. 1, 1995

[86] PCT No.: PCT/EP95/02091

§ 371 Date: Nov. 20, 1996

§ 102(e) Date: Nov. 20, 1996

[87] PCT Pub. No.: WO95/34465

PCT Pub. Date: Dec. 21, 1995

[30] Foreign Application Priority Data

Jun. 16, 1994 [DE] Germany ..... 44 20 798.0

[51] Int. Cl.[6] ..... B63C 9/00

[52] U.S. Cl. ..... 441/80; 114/144 A; 114/144 C; 114/144 E

[58] Field of Search ..... 114/144 E, 144 A, 114/144 C; 441/80

[56] References Cited

U.S. PATENT DOCUMENTS

| | | | |
|---|---|---|---|
| 3,336,891 | 8/1967 | Stark | 114/144 E |
| 3,741,474 | 6/1973 | Kawada et al. | 114/144 E |
| 3,888,201 | 6/1975 | Zuvela | 114/144 R |
| 4,040,374 | 8/1977 | Greene | 114/144 C |

FOREIGN PATENT DOCUMENTS

| | | | |
|---|---|---|---|
| 2 487 286 | 1/1982 | France . | |
| 2 685 282 | 6/1993 | France | 441/80 |
| 91/06466 | 5/1991 | WIPO | 114/144 A |
| 94/06679 | 3/1994 | WIPO . | |

*Primary Examiner*—Sherman Basinger
*Attorney, Agent, or Firm*—Herbert Dubno

[57] ABSTRACT

An automatic controller for the helm of a watercraft uses sensors responsive to starboard and port contacts, with the predominating of the starboard and port contacts signalling the heeling of the watercraft. A transmitter attached to the person of the operator of the vessel is triggered should the operator fall into the water, to transmit a signal to the receiver attached to the electronic controller and thereby cause the watercraft to turn into the wind and prevent the distance between the vessel and the overboard person from increasing.

18 Claims, 1 Drawing Sheet

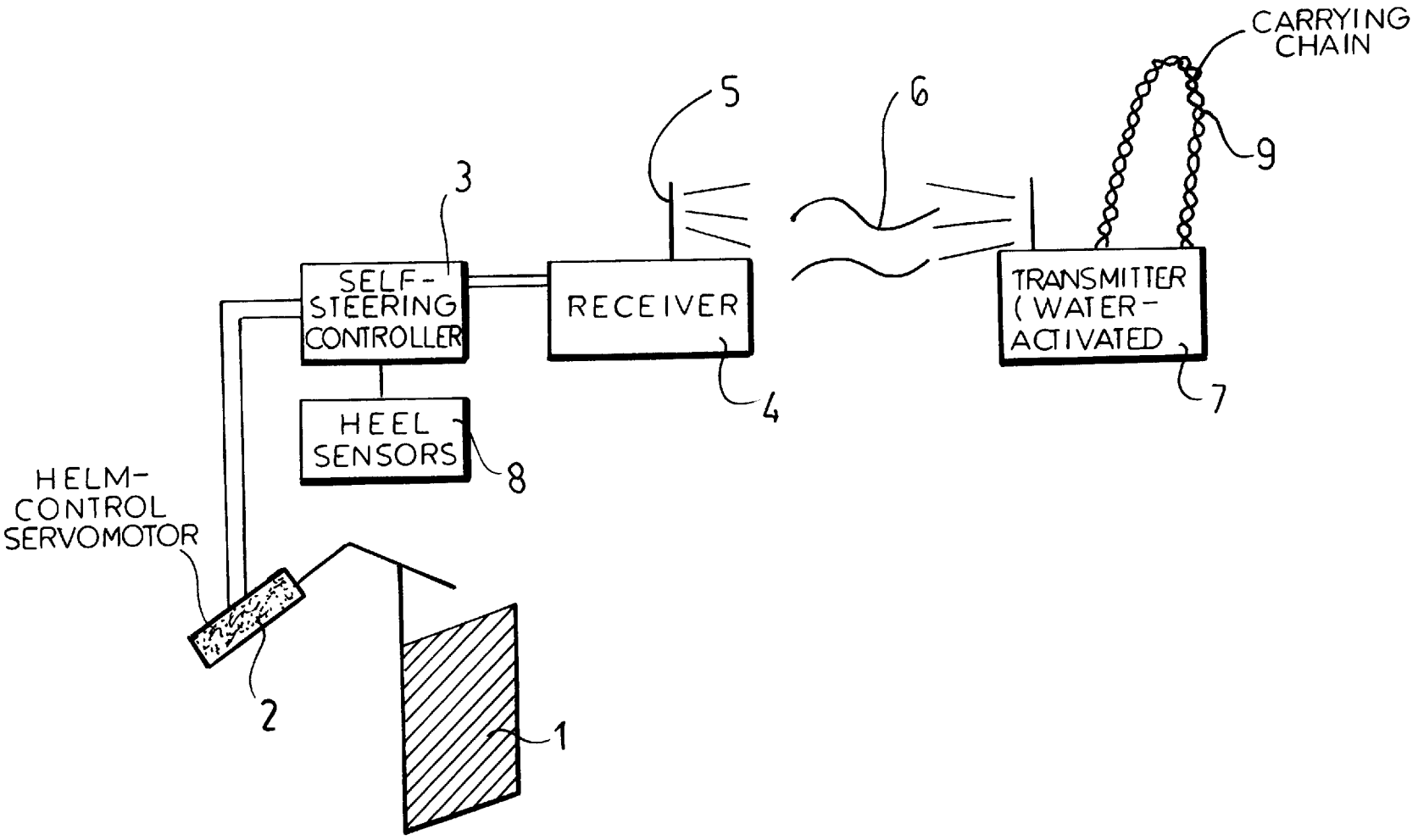
CARRYING CHAIN
9
TRANSMITTER (WATER-ACTIVATED)
7
6
5
RECEIVER
4
3
SELF-STEERING CONTROLLER
HEEL SENSORS
8
1
2
HELM-CONTROL SERVOMOTOR

SELF-STEERING SYSTEM FOR WATERCRAFT

CROSS REFERENCE TO RELATED APPLICATIONS

This application is a national stage of PCT/EP95/02091 filed Jun. 1, 1995 and based, in turn, upon German application P4420798.0 filed Jun. 16, 1994 under the International Convention.

FIELD OF THE INVENTION

The present invention relates to a self-steering system for watercraft, in particular for pleasure craft and sailboats, with an automatic control device, by means of which a watercraft's helm can be adjusted.

BACKGROUND OF THE INVENTION

At the present time, pleasure craft, sailboats, and similar watercraft use a variety of self-steering systems and autopilots. These self-steering systems differ according to two different operating principles:

First, there are self-steering systems in the form of wind vanes that have a purely mechanical mode of operation, whereby the direction of movement of the watercraft is manipulated by the mechanical transmission of force between a wind vane and a pendulum-type rudder that works in the opposite direction. Self-steering systems of this kind are used exclusively on sailboats, and are suitable only for keeping the watercraft or the sailboat on the correct course relative to the wind. As soon as the direction of the wind changes, the sailboat leaves its compass course and follows the rotation of the wind. Self-steering systems of this kind operate without using any electrical current. They can only be manipulated mechanically.

There are, secondly, also self-steering systems that operate electronically. These are the so-called flux gate compass systems. These self-steering systems sample the Earth's magnetic field by means of built-in field coils and determine the angle between the longitudinal axis of the vessel and the lines of force that run between the Earth's poles. Such electronic self-steering systems always steer the watercraft on the compass course that is set at the time the self-steering system is switched on. Such electronic self-steering systems can also be combined with wind vanes. The steering movements that are required to keep on course, and which have to adjust the helm, are transmitted by means of a control device in the form of adjusting or servomotors.

The autopilots described above can keep a watercraft on course with sufficient safety and can provide the crew, which is usually small, with adequate relief from monotonous spells of work at the helm. Providing they are functioning properly, the steering accuracy offered by autopilots is much greater than can be achieved by a human helmsman or operator.

The great disadvantage of autopilots of this kind is that the watercraft will continue its course without change if the sole skipper or operator who is at the helm goes overboard. This danger exists not only for solo sailors, but also for crews such as families. There have been cases of the total loss of both crew and boat when the skipper or operator has gone overboard and the crew, frequently wife and children, were unable to turn the vessel, pick up the skipper or operator, and continue their voyage.

OBJECT OF THE INVENTION

It is the object of the present invention to provide a self-steering system such that in the event that the skipper or the helmsman goes overboard, the vessel is prevented from continuing on the course for which the autopilot has been set.

SUMMARY OF THE INVENTION

According to the present invention, a transmitter that can be a separate part of the control device, is attached to the pilot or skipper and transmits a "man overboard" signal to a receiver that is a part of the control device and by means of which the "man overboard" signal sent by the transmitter can be received. The control device and thus the helm can be be affected in such a way that the distance between the vessel and the sender unit does not increase. This is achieved in that on receipt of the "man overboard" signal, the receiver acts on the control device in such a way that the vessel is pointed into the wind by operation of the helm. In the case of vessels with a self-tacking jib, it is expedient to sail with this close-hauled at all times, with heel being measured in each instance and opposite rudder applied. The skipper or operator who goes overboard then has a reasonable certainty of being able to get back on board the vessel again and take control of it.

In the case of autopilots that are purely mechanical, it is advantageous that the control device be part of a mechanical wind vane.

More expediently, the autopilot can incorporate an electronic controller into which course data and the like can be inputted and in which such course data can be processed, together with other parameters that are inputted, e.g. wind and current speeds and directions, so as to generate output signals that can be inputted from the control unit into the control device, the receiver being connected to the electronic controller; a "man overboard" signal picked up by the receiver is processed there, and inputted into the controller unit, where it interrupts the program that will be running until the "man overboard" signal is inputted.

Because of the possible determination of wind direction, for example by measurement of heel, by wind measurement, or by other suitable devices, it is ensured that the vessel cannot fall off if lee rudder is applied, particularly if this is done accidentally. The intelligent software that is used in the self-steering system according to the present invention is able to make decisions with respect to the vessel type, the vessel's handling characteristics, and wind conditions from the known sea-going characteristics and general dynamics.

It is advantageous that an electronic controller of this kind be configured as a flux-gate compass system. The steering dynamic of the vessel can be checked by evaluation of the directional information that is made available by the compass system. By evaluation of the steering dynamic, e.g. the rate of turn of the vessel, it is possible, for example, to determine the wind direction without using a wind-measurement apparatus.

The adjusting device can be configured inexpensively as a servomotor.

To the extent that the vessel has tiller steering it is appropriate that the servomotor be configured as a linear motor.

If the vessel is fitted with mechanical wheel steering, it is appropriate that a motor with a gear-drive system be provided as the servomotor.

If the vehicle vessel is fitted with hydraulic wheel steering, the servomotor should be in the form of a hydraulic pump.

In order to ensure that it operates properly when it is used, the transmitter has a watertight encapsulated housing so as to prevent the ingress of water, and to avoid any consequent loss of functionality.

If the transmitter is provided with a Velcro-type strap, it can be attached to the collar of a flotation device or the like.

If the transmitter has a carrier chain, it can be worn around the skipper's or the helmsman's neck.

In order to ensure that the transmitter remains on the surface of the water, from where it can transmit, it is best constructed so as to be buoyant in water.

It is an advantage if the transmitter can be triggered both automatically and manually. In some cases, however, it may be appropriate to so configure the transmitter that it can be triggered either automatically or manually.

Automatic triggering of the transmitter is simple to achieve if the transmitter has a triggering device that starts the operation of the transmitter when it comes into contact with water. If it is configured in this way, the transmitter can also be triggered if the pilot or skipper loses consciousness as a result of the event that resulted in him going overboard and if, as a result of this, he is unable to trigger the transmitter for himself once he is in the water.

In order to ensure that a transmitter of this kind cannot be triggered unintentionally, it is appropriate that the transmitter triggering device be protected against spray.

It is also an advantage if the transmitter can also be operated manually by means of a pressure switch. This pressure switch can then be operated by the skipper or operator if he has not lost consciousness. This possibility is an advantage, in particular, in those cases when it is not certain that the transmitter has been triggered. Transmission of the coded, digitized "man overboard" signal by the transmitter should continue uninterrupted so that reliable reception of the "man overboard" signal by the receiver is ensured in all instances. The emission of the "man overboard" signal in an uninterrupted sequence is thus important, since, for technical reasons, this signal cannot be radiated under water. Since, however, it is impossible to predict how long a pilot or skipper who has gone overboard will remain under water, it is only permanent emission of the "man overboard" signal by the transmitter that will ensure that this signal will be picked up by the receiver at some time or other.

If the transmitter emits a permanent test signal and the self-steering system incorporates an alarm that gives an alarm signal if the permanent test signal is not received by the receiver, it can be ensured that, in the event that the radio link between the transmitter and receiver is not functioning, this fact can be identified immediately.

If the self-steering system incorporates a circuit, which is not a dead man's switch, with adjustable reaction time, the skipper or operator who is wearing the transmitter can stop the false alarm within the time period defined by the reaction time that has been selected, and can thus prevent the vessel from coming about.

It is appropriate that the energy for the transmitter be provided by means of a 9-volt battery.

The receiver is also encapsulated in a watertight housing in order to ensure that it will operate when wet.

This watertight encapsulated housing, and thus the receiver, is arranged in the immediate vicinity of the controller of the self-steering system.

It is appropriate that the receiver have an external antenna that is as high as possible, i.e., is attached to the mast or the radar bridge on board the vessel. This ensures the clearest possible reception of the "man overboard" signal, even in the most adverse sea conditions.

In order to ensure the supply of energy to the receiver, it is best connected to the vessel's 12-volt or 24-volt onboard power supply system.

In order to connect the receiver to the controller, this is best provided with a interface that is compatible with commercially-available self steering systems, e.g., in NEMA data format. The same interface as that used to connect GPS or Decca navigational systems is also used to connect the receiver to the controller of the self-steering system or the autopilot. The following are suitable inputs: inputs of a wind vane that may be connected or for a cable-type remote control or an input to connect a GPS or Decca navigation system.

By using suitable sensors, the controller can determine the heel of the vessel or sailboat, i.e. the direction in which the vessel is heeling, and can thus determine the direction of the wind in relation to the longitudinal axis of the vessel.

All types of mechanical and/or electronic inclinometers or mechanical and/or electronic devices that sense the position of the main mast relative to the longitudinal direction of the vessel, or mechanical and/or electronic sensors for other masts, e.g., foremast or mizzen mast, can be used as sensors for this purpose.

To the extent that the number of starboard or port contacts that arrive at the sensors in unit time can be picked up, and the more frequent starboard or port contacts can be used to determine the heel, the heel can be determined reliably even in a heavy sea; this is particularly important with respect to small sail boats, since sailing vessels of this kind can be tossed about violently in heavy seas.

More appropriately, the receiver incorporates a separate circuit output, which can have a 12-volt or 24-volt output voltage, with which simple switching functions can be performed. This means that the receiver can, for example, switch off the engine of the vessel by way of incorporated relays, so that even motor yachts can be stopped.

The present invention also relates to a device for rendering a watercraft's self-steering system inoperative, this device having the transmitter and the receiver described above, and being suitable for incorporation into an existing self-steering system.

BRIEF DESCRIPTION OF THE DRAWING

The present invention will be described in greater detail below on the basis of the sole FIGURE of the drawing appended hereto; this drawing illustrates the principle of the self-steering system according to the present invention.

SPECIFIC DESCRIPTION

The electronic self-steering system shown in the drawing provides automatic steering for watercraft, in particularly pleasure craft and sail boats.

Watercraft of this kind have a helm 1, the position of which is used to change the direction of movement of the watercraft. A control device 2 is connected to the helm 1, and this can be in the form of a servomotor, for example.

This control device 2 makes adjustments to the helm 1 when it receives appropriate control signals from an electronic controller 3 that is part of the self-steering system.

A receiver 4 is connected to the electronic control 3, and this has an external antenna 5 by which a "man overboard" signal 6 is received, said signal being emitted by a transmitter 7 if the skipper or operator who is wearing the transmitter 7 in a suitable form e.g. via a carrying chain 9, goes overboard.

If this is the case, the transmitter 7 is triggered and, as has been described above, sends the "man overboard" signal. This signal is received by the external antenna 5 of the receiver 4. The receiver 4 sends a signal that notifies reception of a "man overboard" signal 6 to the electronic controller 3, in which the electronic circuitry sends control signals to the control device 2 as a logical function of the heel on the vessel or on the basis of signals from mechanical sensors; these signals then head the sailboat into the wind.

On small sail boats, it is extremely difficult to measure the vessel's heel in a heavy sea, since sailboats of this kind can be tossed about violently in a heavy sea. This problem has been solved in that the number of starboard or port contacts measured by the sensors 8 per unit time, e.g., 20 to 40 seconds, is determined, and then the value that is most frequently measured is taken as the direction of heel.

The sensors connected to the electronic control controller sense when the sailboat comes about to another tack and the electronic controller 3 seconds the appropriate control signals to the control device 2, whereupon the latter puts the helm 1 hard over onto the opposite tack. The sailboat then heaves to with the jib back-winded.

If the sailboat is equipped with a self-tacking jib, it will always be sailed off the wind. For all practical purposes, a control routine "measure heel and apply opposite helm" will be processed. The sailboat will then always heave to.

The section of the self-steering system according to the present invention that consists of the receiver 4 and the transmitter 7 can be used in conjunction with conventional controllers in commercially-available self-steering systems. These controllers have the usual control devices, which are formed as servomotors or hydraulic pumps that transfer the desired changes of course to the helm. The section made up of the receiver 4 and the transmitter 7 does not require a dedicated servomotor, and so conventional self-steering systems can be fitted very simply with the section consisting of the receiver 4 and the transmitter 7 without any major modifications, when the associated installation costs will be comparatively small.

I claim:

1. A self-steering system for a watercraft comprising:

an automatic control device for controlling a helm of a watercraft;

an electronic controller connected to said automatic control device and provided with sensors responsive to heeling of the watercraft and automatically operating said automatic control device to maintain a heading for said watercraft;

a transmitter provided with means for attaching the transmitter to the person of an operator of the watercraft and triggerable at least by contact with water for transmitting a "man overboard" signal; and a receiver connected with said electronic controller and receiving said "man overboard" signal for operating said electronic controller for turning said watercraft into the wind in conjunction with said sensors and preventing an increase in a distance between the watercraft and the transmitter, said sensors being positioned to detect starboard and port contacts whereby said electronic controller responds to the predominating of the starboard and port contacts to measure heeling of the watercraft, a permanent test signal being transmitted by said transmitter and said receiver being an alarm device that emits an alarm siganl if the permanent test signal is not received by said receiver.

2. A self-steering system as defined in claim 1 in which said control device is a wind vane control.

3. A self-steering system as defined in claim 1 wherein said electronic controller is constructed and arranged to accept course data and in which such course data, together with other parameters that are inputted including wind and current speeds and directions, is processed to form output signals controlling said helm, the receiver being connected to the electronic controller, a "man overboard" signal received by the receiver being processed therein and inputted into the controller to run a program putting the watercraft into the wind until the arrival of the "man overboard" signal is interrupted.

4. A self-steering system as defined in claim 1 wherein said controller is a flux-gate compass system.

5. A self-steering system as defined in claim 1 wherein said control device is a servomotor.

6. A self-steering system as defined in claim 5 wherein the servomotor is a linear motor.

7. A self-steering system as defined in claim 1 where the transmitter has an encapsulated watertight housing.

8. A self-steering system as defined in claim 1 wherein the transmitter is fitted with a carrying chain.

9. A self-steering system as defined claim 1 wherein the transmitter is so constructed that buoyancy forces act on it when it is in water.

10. A self-steering system as defined in claim 1 wherein the transmitter has a pressure switch by means of which it can be operated manually.

11. A self-steering system as defined in claim 1 wherein a coded, digitized, continuous "man overboard" signal is transmitted by the transmitter.

12. A self-steering system as defined in claim 1 which incorporates a non-deadman's circuit with a switch of adjustable reaction time.

13. A self-steering system as defined in claim 1 wherein a battery is provided as an energy supply for the transmitter.

14. A self-steering system as defined in claim 1 wherein the receiver is encapsulated so as to be watertight.

15. A self-steering system as defined in claim 1 wherein the receiver is arranged in the immediate vicinity of the controller.

16. A self-steering system as defined in claim 1 wherein the receiver has an external antenna.

17. A self-steering system as defined in claim 1 wherein the receiver for the controller is provided with an interface that is compatible with commercially-available self-steering systems.

18. A self-steering system as defined in claim 1 wherein the receiver incorporates a separate circuit output, by which an engine is rendered inoperable.

* * * * *